United States Patent [19]

Kawakita

[11] 4,257,730

[45] Mar. 24, 1981

[54] STAND DEVICE FOR BOOM-TYPE WORKING IMPLEMENTS

[75] Inventor: Hiroaki Kawakita, Sakai, Japan

[73] Assignee: Dukane Corporation, St. Charles, Ill.

[21] Appl. No.: 34,619

[22] Filed: Apr. 30, 1979

[30] Foreign Application Priority Data

May 4, 1978 [JP] Japan ..... 53/60337[U]

[51] Int. Cl.[3] ..... B65D 90/14

[52] U.S. Cl. ..... 414/686

[58] Field of Search ..... 414/686, 718, 685, 687, 414/688

[56] References Cited

U.S. PATENT DOCUMENTS 3,833,136 9/1976 Spicer et al. ..... 414/686

FOREIGN PATENT DOCUMENTS 1240195 7/1960 France ..... 414/686

*Primary Examiner*—Stanley H. Tollberg

*Attorney, Agent, or Firm*—Vogel, Dithmar, Stotland, Stratman & Levy

[57] ABSTRACT

A device for a boom-type working implement which has a working member and a connector both attached to a boom and which is connectable to a tractor by the connector. The device comprises a stand member having one end pivoted to the boom and the other end provided with a ground engaging portion, and a connecting member having one end pivoted to the stand member and the other end pivoted to the boom. The stand member can be held by the connecting member at an angle with the boom, with the ground engaging portion positioned to the rear of and spaced apart from the working member. The stand member can be held to the boom coextensively therewith by disengageable means.

11 Claims, 13 Drawing Figures

9
15
12
10
43
22
8
8
24
34
14
40
25
21
8
26
17
23
25
28
27
29
31
39
6
18
19
5
16
30

STAND DEVICE FOR BOOM-TYPE WORKING IMPLEMENTS

BACKGROUND OF THE INVENTION

The present invention relates to a stand device for boom-type working implements such as loaders, snow ploughs, field choppers and the like, and more particularly to a stand device for the boom-type working implement to be attached to a tractor.

Loaders, snow ploughs, field choppers and like working implements include a boom having one end provided with a connector for attaching the implement to a tractor and the other end provided with a working member such as a bucket, fork or discharge chute.

Such boom-type working implements are used as detachably attached to a tractor. Preferably the working implement is placed on the ground in an upright position when detached from the tractor, because the tractor can be driven toward the working implement and is connectable to the connector at one end of the boom with extreme ease when the implement is to be used again. Additionally the connector pins, which are usually withdrawable, can then be aligned with the pin bores easily for the connection.

The detached boom-type working implement, even when placed with the working member in contact with the ground at one end of the boom, may not be held in balance under gravity and is therefore liable to fall and become damaged, deformed or less durable. For this reason, it is also desirable to keep the implement in its upright position. In fact, many of boom-type working implements are equipped with a stand device of simple construction which permits a trouble-free operation.

Conventional stand devices generally comprise a telescopic stand assembly having at its one end a hook engageable with a longitudinally intermediate portion of the boom and at the other end a ground engaging pad, such that the boom is held at an angle with the stand assembly to hold the implement in an upright position.

Such a conventional stand device, with its stand assembly detachably engaged with the boom by a hook, nevertheless is very unstable against a load acting longitudinally of the boom. Since the device is subjected to the longitudinal load when the implement is to be attached to the tractor, there is the likelihood that the hook will be disengaged from the boom.

Furthermore the stand assembly of the telescopic type, which comprises a rod slidable in and lockable to an outer cylinder, can not always support a vertical load as desired, possibly failing to hold the implement upright and to serve as a stand.

SUMMARY OF THE INVENTION

An object of the present invention is to provide a stand device for a boom-type working implement having a boom, a connector attached to one end of the boom and a working member attached to the other end of the boom, the stand device comprising a stand member having one end pivoted to the boom and the other end provided with a ground engaging portion, and a connecting member connecting the stand member to the boom so as to hold the working implement in an upright position with stability even when subjected to a load acting longitudinally of the boom.

Another object of the invention is to provide a stand device of the type described with which the working member at the front end of the boom and the ground engaging portion of the stand member are adapted to be placed on the ground with the ground engaging portion positioned to the rear of and spaced apart from the working member, the connecting member connecting the boom to the stand member which is pivoted at its upper end to the boom, such that the working implement as detached from a tractor can be held in an upright position with good stability even when the device is subjected to a vertical load.

Another object of the invention is to provide a stand device of the type described which further includes means for holding the stand member to the boom coextensively therewith when the stand member is disconnected from the boom or the connecting member at the pivoted portion or when the connecting member is disconnected from the boom at the pivoted portion so that the stand member can be held to the boom compactly while not in use even during the operation of the working implement.

Another object of the invention is to provide a stand assembly comprising a pair of opposite stand devices of the type described above as provided for a pair of opposite booms respectively, the assembly including means for interconnecting the opposed stand members in pair, such that the working implement can be held in an upright position with improved stability by the pair of stand devices.

Still another object of the invention is to provide a stand device including a guide portion for guiding the stand member longitudinally of the boom as means for pivoting the stand member to the boom, the guide portion being cooperative with the connecting member to render the stand member accurately and smoothly shiftable from a position in which it is held out of use as attached to the boom to a position in which it is in use, and vice versa.

Still another object of this invention is to provide a stand device which is extremely useful, simple in construction and very convenient to handle.

BRIEF DESCRIPTION OF THE DRAWINGS

The drawings show the present invention as applied to a front loader for illustrative purposes.

DETAILED DESCRIPTION OF THE INVENTION

Figure 1:
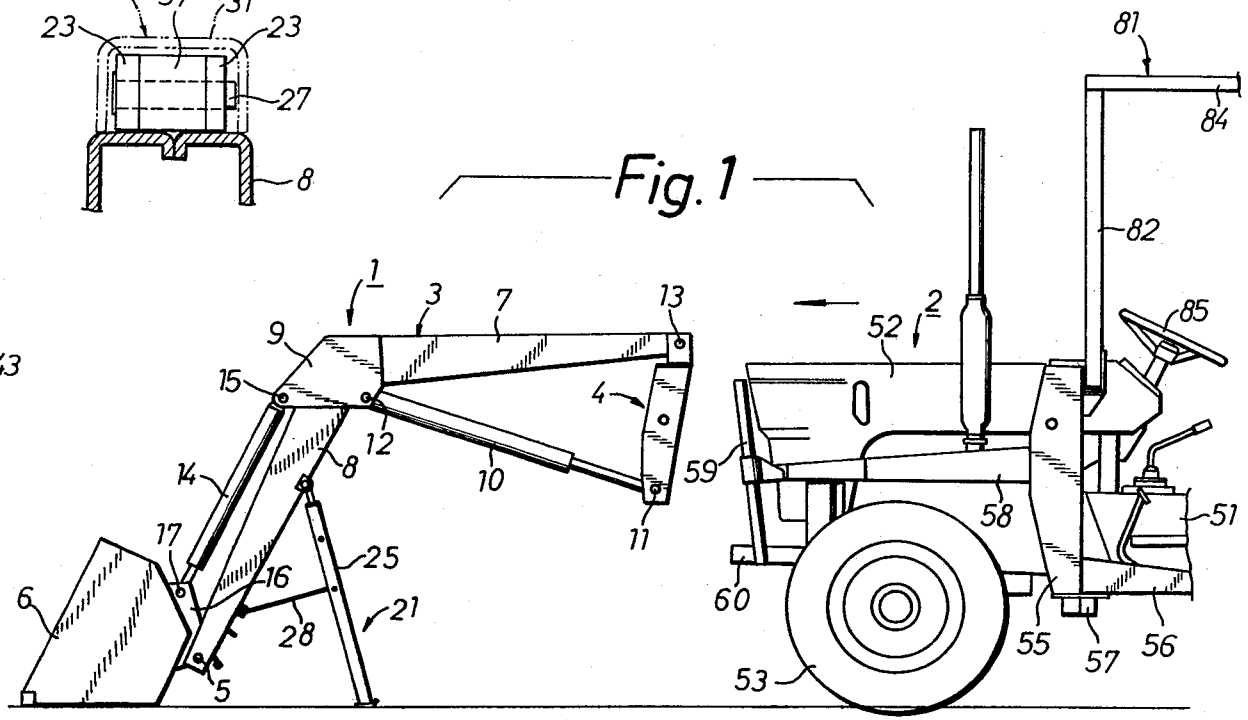
FIG. 1 is a fragmentary side elevation showing a front loader in its upright position and a tractor before the loader is attached to the tractor.

With reference to FIGS. 1 to 5 showing the most preferred embodiment of the invention, indicated at 1 is a front loader as a boom-type working implement, and at 2 a wheel-type tractor.

The front loader 1 has a pair of opposite booms 3, a connector 4 attached to one end of each of the booms 3, and a working member 6 which is specifically a bucket turnable on a lateral pivot 5 between the other ends of the booms 3.

Figure 4:
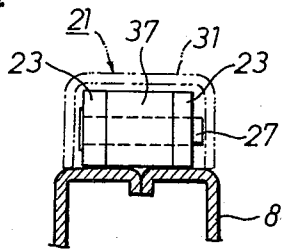
FIG. 4 is a view in section taken along the line 4—4 in FIG. 3.

As seen in FIG. 4, the boom 3 is made from a pair of channel members which are joined together to provide a channel. In the illustrated embodiment, the boom 3 comprises a first boom segment 7 and a second boom segment 8 which are firmly joined to each other by intermediate plates 9 as shown in FIG. 1. The second boom segment 8 is flexed downward at the connecting plates 9.

A pair of opposite lifting cylinder means 10 are of the hydraulic telescopic type according to the illustrated embodiment. Each cylinder means 10 has one end pivoted by a pin 11 to a lower portion of the connector 4 and the other end pivoted by a pin 12 to the connecting plates 9. The rear end of each first boom segment 7 is pivoted by a pin 13 to an upper portion of the connector 4, so that the lifting cylinder means 10 raises the boom 3 when extended and lowers the boom 3 when collapsed.

A pair of opposite tilting cylinder means 14, which are of the hydraulic telescopic type in the present embodiment, each have one end connected by pins 15 to the connecting plates 9 and the other end pivoted by a pin 17 to one of a pair of brackets 16 fixed to the rear wall of the working member 6. The cylinder means 14 extend in parallel to the second boom segment 8 longitudinally thereof and turn the working member 6 about the lateral pivot 5, for example, counterclockwise in FIG. 2 when extended and clockwise when collapsed. As seen in FIG. 3, the second boom segment 8 is provided at an end portion thereof with a stopper 18 for restraining the counterclockwise turn of the working member 6. Preferably the stopper 18 is detachably provided with a block 19 of rubber or elastic resin for contact with the working member 6.

Figure 5:
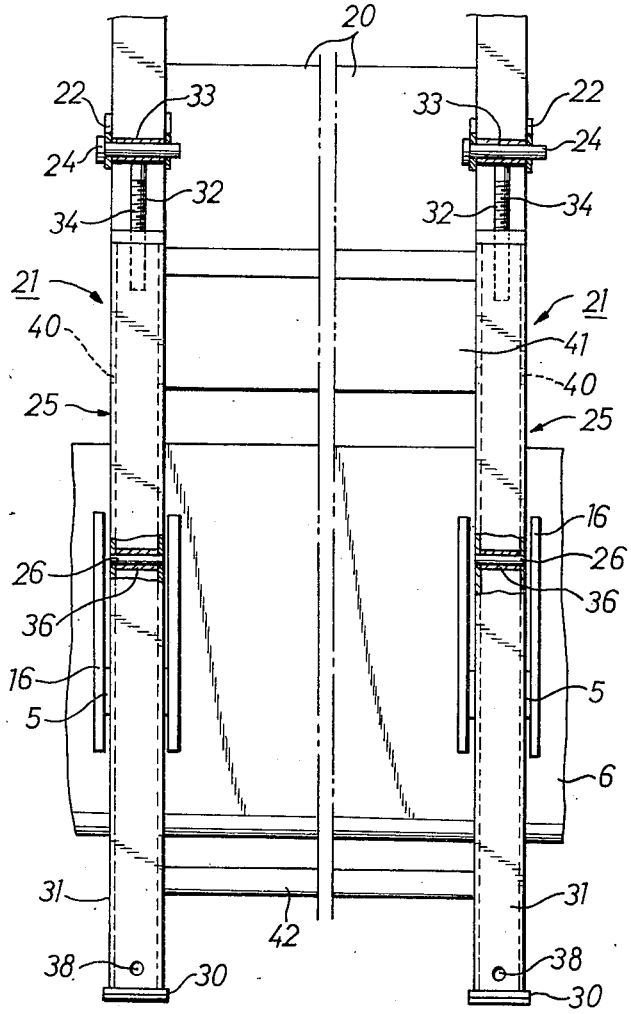
FIG. 5 is a fragmentary rear view partly broken away showing a portion of the embodiment as it is seen in the direction of an arrow 5 in FIG. 3.

The pair of booms 3 are interconnected by a reinforcing plate 20 at an intermediate portion of their length (see FIG. 5). The booms 3 are spaced apart by a distance not smaller than the width of the tractor 2.

The front loader 1 of the above construction is equipped with a stand device 21.

With reference to FIGS. 3 to 5, the stand device 21 is attached to longitudinally intermediate portions of the booms 3. The stand device 21 comprises support members 22 and 23 attached to the booms 3 and spaced apart longitudinally of the booms, stand members 25 pivoted to the upper support members 22 by connecting pivots 24 which are shown as detachable pins, connecting members 23 each having one end pivoted by a connecting pivot 26 to an intermediate portion of the stand member 25 and the other end pivoted by a connecting pivot 27 to the lower support member 23, and means 29 for holding the stand members 25 to the booms 3 coextensively therewith while the stand device is not in use. The connecting pivots 26 and 27 are each in the form of a pin which is detachable in the present embodiment.

In view of the position of the lifting cylinder means 10, it is preferable to attach the stand device 21 to the second boom segments 8.

Each of the stand members 25 comprises a first element 31 which preferably is in the form of a channel member and is fixedly provided at its one end with a ground engaging portion 30, and a second element 34 integral with a tubular bearing portion 33 and with a threaded portion 32 screwed in the other end of the first element 31. Preferably the ground engaging portion 30 is in the form of a pad. The bearing portion 33 is turnably supported on a pin 24 which is withdrawably inserted in the support members 22.

Although the length of the stand member 25 is adjustable by the threaded portion 32 within the range of the length of the threaded portion, the bearing portion 33 can be fixed to the above-mentioned other end of the first element 31 when it is not desired to render the length of the stand member 25 adjustable.

The stand member 25 is pivoted to the upper support members 22 on the second boom segment 8 by the cooperation of the bearing portion 33 and the pin 24, preferably with the open side of the first element 31 of the member 25 facing the second boom segment 8, partly because the support members 23 can be covered with the first element 31 as indicated in phantom lines for example in FIG. 4 when the stand device 21 is held to the booms 3 while it is out of use and partly because the device 21 can be so held compactly. Similarly the first element 31 is adapted to cover the upper support members 22 as indicated in a phantom line in FIG. 3.

The connecting member 28 connecting each of the stand members 25 to the second boom segment 8 opposed thereto is in the form of a solid rod having tubular bearing portions 36 and 37 at its opposite ends respectively. The bearing portion 37 is pivoted to the lower support members 23 by a withdrawable pin 27, while the other bearing portion 36 is detachably supported on the first element 31 of the stand member 25, by a pin 26 passed through the element 31 sidewise and through the portion 36. Thus the connecting member 28 serves to guide the stand member 25 to the solid-line set position shown in FIG. 3 in which the member 25 is at an angle with the second boom segment 8, also serving to hold the stand member 25 spaced from the working member 6. Accordingly the front loader 1 can be held in its upright position by the stand device 21, with the ground engaging portions 30 of the stand members 25 positioned to the rear of and spaced from the working member 6 on the ground.

Although not shown in FIG. 3, the stand member 25 may be provided with a plurality of bores for passing the pin 26 therethrough which pin is withdrawably inserted in the bearing portion 36. The angle of the stand member 25 with respect to the second boom segment 8 is then adjustable. This adjustment and the adjustment of the length of the stand member 25 afforded by the threaded portion 32 make it possible to adjust the level of the connector 4 at one end of the boom 3 without varying the spacing between the working member 6 and the ground engaging portions 30.

It is seen in FIG. 3 that the stand member 25 is formed in its rear wall with a pin bore 38 positioned close to the ground engaging member 30 for passing therethrough a pin 39 extending from the second boom segment 8 and located near the lower support members 23 therebelow. The cooperation of the pin 39 and the bored portion 38 provides means 29 for holding the stand device 21 to the booms 3.

Stated more specifically according to the embodiment shown in FIG. 3, the stand device 21 can be held to the boom segments 8 by withdrawing the pivots 24 from the connections between the stand members 25 and the segments 8, positioning the stand members 25 along the segments 8 as indicated in the phantom line in FIG. 3 with the stand members 25 connected to the segments 8 by the connecting members 28, inserting the pins 39 into the bores 38 and inserting an unillustrated retaining pin into each of the pins 39 at right angles thereto. Preferably the pin 39, upper and lower support members 22, 23 and connecting member 28 are covered with the first stand element 31 as accommodated in its open channel portion as already stated. Further the stand device 21 can be held to the boom segment 8 more effectively if the upper and/or lower support members are adapted to engage in the channel portion of the member 31. Such engagement also partly affords the holding means for preventing inadvertent disengagement of the stand device 21 due to vertical movement or shake during travel when the front loader 1 is operated as attached to the tractor 2.

Additionally the stand member 25 is formed with another pin bore 40 extending sidewise through an upper portion thereof and cooperative with the pivot 24 to provide another holding means 29.

Put in detail, the stand device 21 can be held to the second boom segment 8 as shown in FIG. 3 by withdrawing the pivot 24 from the member 25 in the solid-line position in FIG. 3, aligning the bores of the support members 22 with the pin bore 40 in the stand member 25 and inserting the pivot 24 into the aligned bores.

One of the holding means 29 described may be used, while it is preferable to use both the holding means 29 comprising the bored portion 38 and the pin 39, and the holding means 29 comprising the bored portion 40 and the pivot 24.

The present stand device 21 should preferably comprise the pair of component units provided for the pair of boom segments 8 respectively. In this case, the stand element 31 of the pair of units are interconnected by plates 41 and 42 at upper and lower positions. While the interconnecting plates 41 and 42 provide a framework to give enhanced rigidity to the stand device, one or both of the plates are usable as handles for handling the stand device 21.

Figure 6:
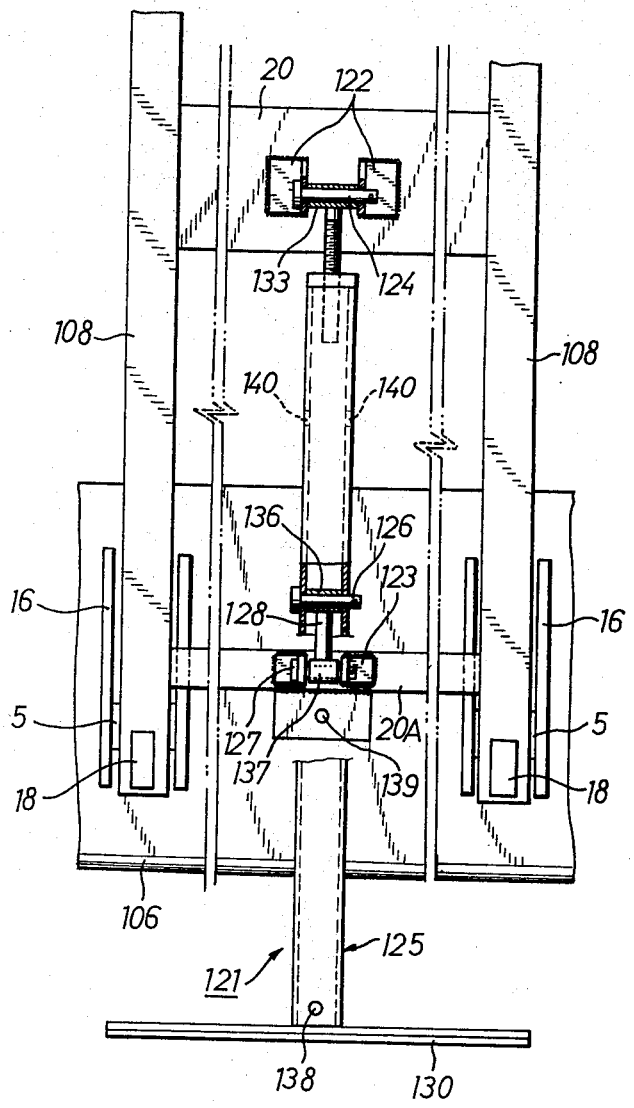
FIG. 6 is a rear view corresponding to FIG. 5 and showing another embodiment of the invention.

The stand device need not always be attached directly to the booms 3. The stand device may comprise only one unit as illustrated in FIG. 6. The device shown in FIG. 6 is basically similar to the embodiment shown in FIGS. 1 to 5.

With reference to FIG. 6, a pair of upper support members 122 is fixed to the center portion of a reinforcing plate 20 between boom segments 108, while a pair of lower support members 123 is fixed to another reinforcing plate 20A connecting the lower ends of the boom segments 8.

A stand member 125 having a bearing portion 133 at one end and a ground engaging portion 130 at the other end and extendable by a screw is pivoted to the support members 122 by a withdrawable pin 124 passed through the bearing portion 133. A connecting member 128 having bearing portions 136 and 137 at opposite ends is pivoted to the lower support members 123 by a pin 127 passed through the bearing portion 137 and to an intermediate portion of the stand member 125 by a pin 126 passed through the bearing portion 136.

According to the embodiment shown in FIG. 6, therefore, the front loader can be held in its upright position by placing a working member 106 and the ground engaging portion 130 on the ground with the portion 130 positioned to the rear of and spaced from the working member 106, and coupling the stand member 125 to the reinforcing plate 20A by the connecting member 128. Since only one stand device 121 is provided at the midportion between the boom segments 108 according to the embodiment shown in FIG. 6, the ground engaging portion 130 is elongated sidewise of the implement.

The stand member 125 shown in FIG. 6 further has upper and lower pin bores 140 and 138. The stand device 121, when not in use, can be held to the boom in the same position as indicated in the phantom line in FIG. 3 by withdrawing the pin 124, positioning the stand member 125 coextensively with the boom, passing the pin 124 through the support members 122 and the bore 140, passing a pin 139 on the reinforcing plate 20A through the pin bore 138 and attaching an unillustrated pin to the pin 139. The pin 124 and the bore 140, as well as the pin 139 and the bore 138, provide means for holding the stand device 121 to the boom.

The working member 106 in FIG. 6 is attached to the boom in the same manner as in FIG. 5. Throughout these drawings, like parts are referred to by like reference numerals.

Figure 8:
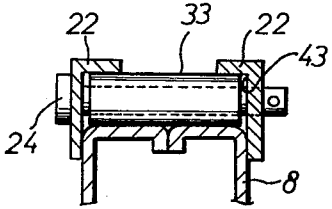
FIG. 8 is a view in section taken along the line 8—8 in FIG. 7.
Figure 9:
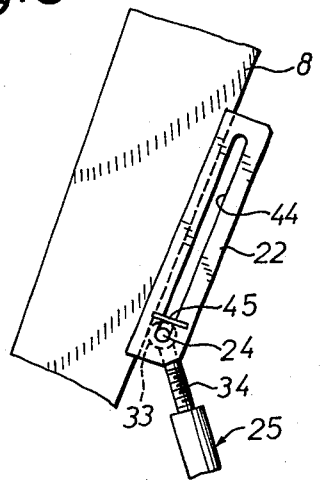
FIG. 9 is a side elevation showing a modification of the pivotal connection between a stand member and a boom.
Figure 7:
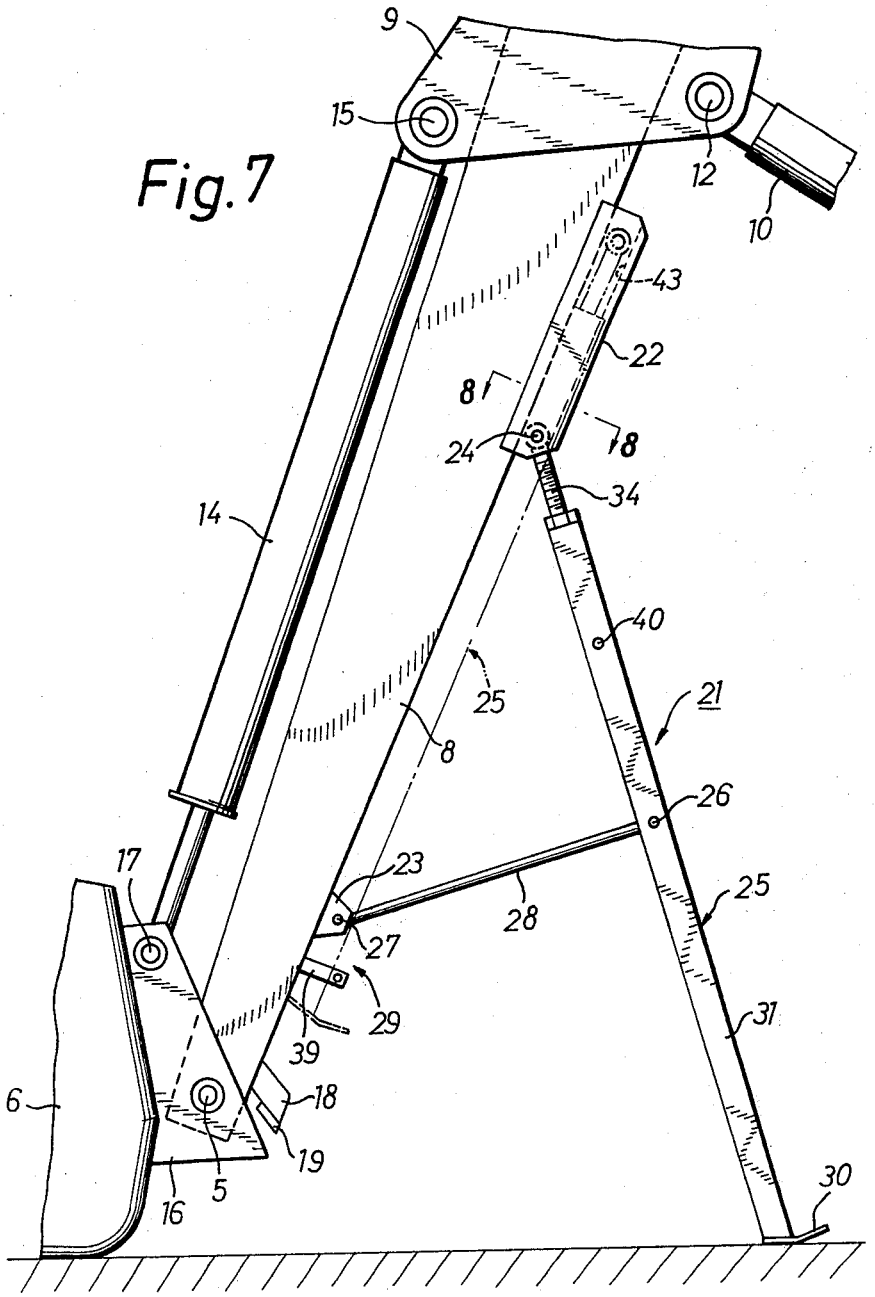
FIG. 7 is a side elevation corresponding to FIG. 3 and showing another embodiment of the invention.

FIGS. 7 to 9 show embodiments of the same construction as the embodiment of FIGS. 3 to 5 except that the support members for pivotably supporting the upper end of the stand member have a different construction. Accordingly like parts are referred to by like reference numerals and will not be described.

With reference to FIGS. 7 and 8, a pair of support members 22 each comprise an angle member and are secured to the boom segment 8 to define a guide groove 43 extending longitudinally of the segment. The bearing portion 33 of the stand member 25 fitting in the groove 43 is slidable along the groove 43. The groove has an open upper end and a closed lower end, such that the bearing portion 33 can be placed into the groove 43 through the upper end but is prevented from slipping off from the lower end.

The support members 22 support the stand member 25 by the pin 24 when in the solid-line position in FIG. 7 and also guide the stand member 25 along the groove 43 when the stand device 21 is brought to the phantom-line position in FIG. 7 along the boom segment 8 with the pin 24 withdrawn.

FIG. 9 shows support members 22 comprising a pair of planar plates formed with a groove 44 for the pin 24 to slide therealong and provided with a detachable stopper 45 in engagement with the bearing portion 33. With the stopper 45 removed, the bearing portion 33 carrying the pin 24 is movable to position the stand member 25 along the boom segment 8. The groove 44 therefore has a large length to permit this movement.

Although the embodiment of FIGS. 3 to 5 and the embodiments of FIGS. 7 to 9 are provided with the support members on the second boom segment as spaced apart longitudinally thereof, the support members may be replaced by pin bores or grooves directly formed in the second boom segment.

With the embodiments described above, the stand member 25 is made shiftable between the position along the boom 3 and another position at an angle with the boom 3 when the pivot 24 is removed from the connection between the stand member 25 and the boom 3, but the stand member 25 is so shiftable when the pivot 26 for connecting the member 28 to the stand member 25 is removed with the pivot 24 retained in position.

Alternatively the stand member 25 is shiftable between the two positions when the pin 27 is removed from the connection between the connecting member 28 and the boom 3. Briefly the stand member 25 is so shiftable when it is disconnected from the boom 3 or from the connecting member 28, or when the connecting member 28 is disconnected from the boom 3.

Furthermore insofar as the stand member 25 is retainable at an angle with respect to the boom 3 with the ground engaging portion 30 spaced apart rearward from the working member 6, the connecting member 28 need not always be positioned at the longitudinal midway portion of the stand member 25 but may be pivoted to the upper or lower portion of the member 25.

With reference to FIGS. 1, 2 and 10 to 13, there is shown means for attaching the connector 4 on one end of the boom 3 to a connecting assembly mounted on the tractor 2.

With reference to FIGS. 2 and 10 to 13, the tractor 2 has an engine 50 positioned closer to its front with a transmission case 51 attached to the engine 50 to provide a tractor frame. The engine is covered with a bonnet 52.

On opposite sides of the tractor frame at its midportion between front and rear wheels 53 and 54 but closer to the front wheels 53, box-shaped upright main frames 55 are provided having an open upper front portion. A pair of opposite connecting frames 56 extend rearward from the lower ends of the main frames 55 along lower side portions of the tractor frame. The rear ends of the frames 56 are fastened rigidly to unillustrated rear wheel axle cases.

The pair of main frames 55 are interconnected by a transverse frame 57 at their lower ends. The frame 57 is rigidly fastened to the bottom of the tractor frame. Thus the main frames 55 are tightly attached to the tractor frame.

Figure 2:
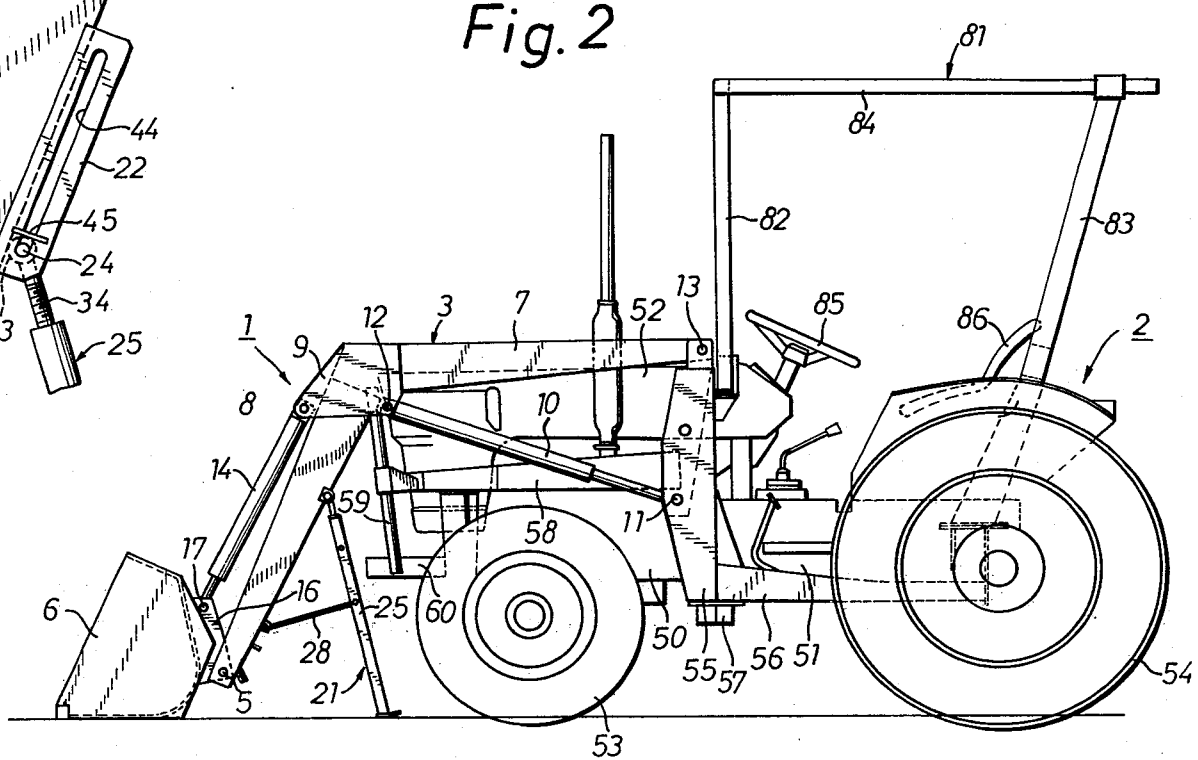
FIG. 2 is an overall side elevation showing the loader as attached to the tractor with a stand device in position for use.
Figure 3:
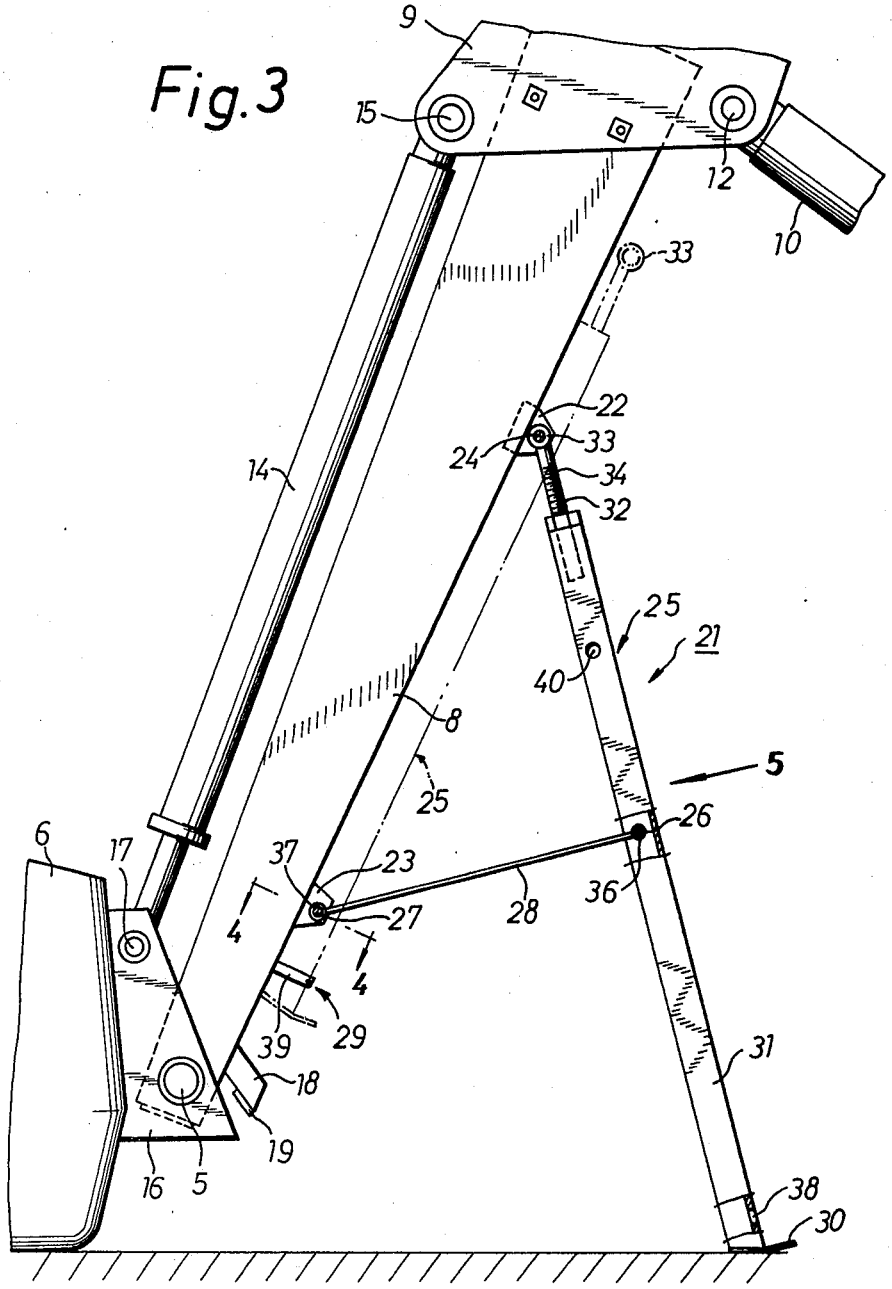
FIG. 3 is a side elevation partly broken away and showing a basic embodiment of the invention in detail.

As shown in FIGS. 1 and 2, a protector frame 58 extends toward the front from a vertically intermediate portion of each main frame 55. A protector 59 opposed to the front grille of the bonnet is connected to the front end of the frame 58. The protector 59 is supported at its lower end by a bamper 60. The protector 59 interconnects the pair of the protector frames 58 in front of the front grille.

Figure 10:
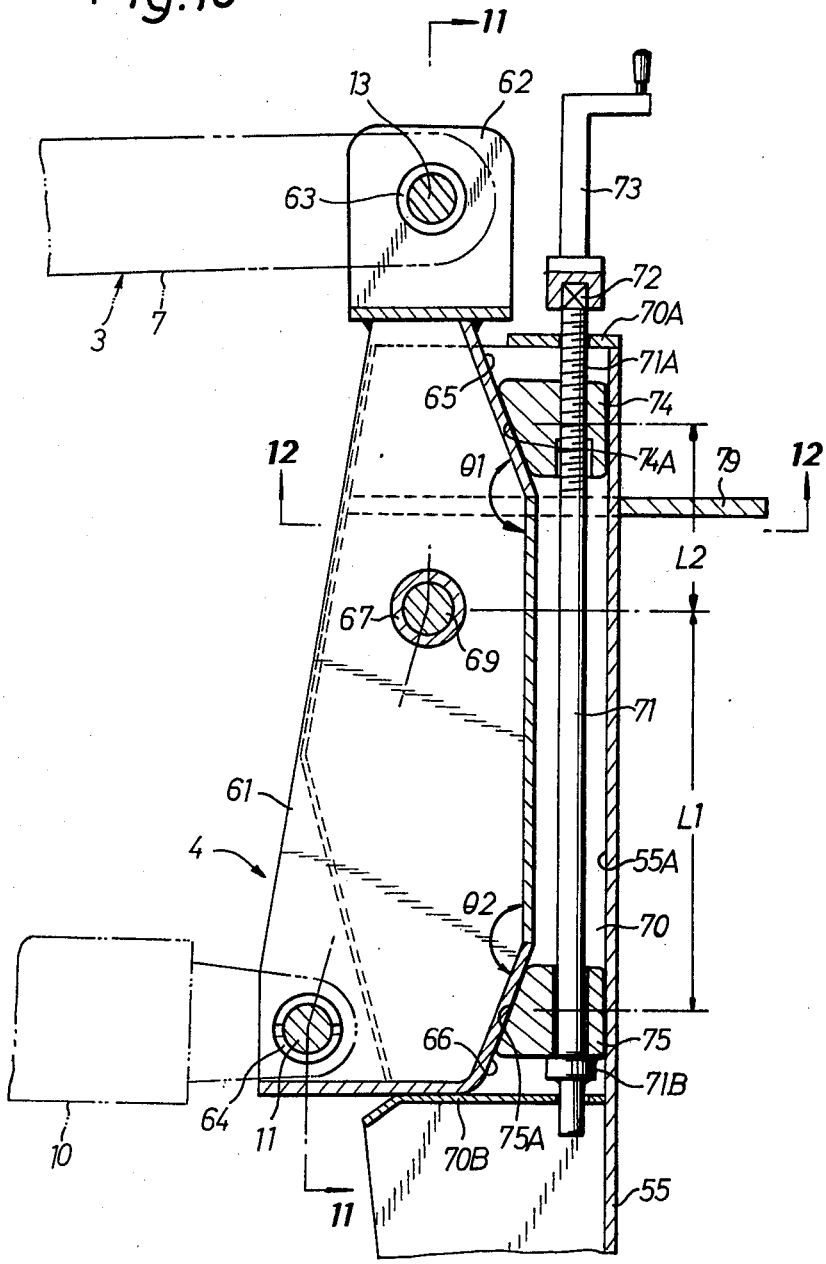
FIG. 10 is a side elevation in section showing in detail a connector on one end of the boom and a connecting assembly on the tractor.
Figure 11:
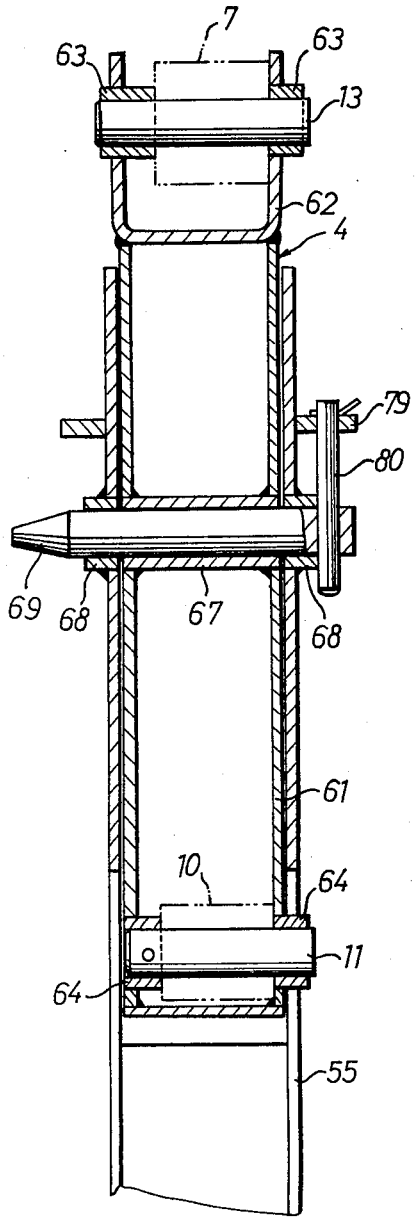
FIG. 11 is a view in section taken along the line 11—11 in FIG. 10.

As shown in FIGS. 10 to 13, each of the connectors 4 attached to the end of the boom 3 of the front loader 1 comprises a subframe 61 in the form of a box. A bifurcated bracket 62 is welded to the top of the subframe 61 and has connected thereto one end of the boom by the pin 13 passed through tubular bosses 63. One end of the lifting cylinder means 10 is connected to a lower portion of the subframe 61 by a pin 11 passed through tubular bosses 64. The subframe 61 is formed on its rear side with upper and lower slanting walls 65 and 66 which are inclined toward each other at equal angles of inclination $\theta_1$ and $\theta_2$ with respect to the vertical rear wall of the frame 61 as seen in FIG. 10. The subframe 61 is fixedly provided at a vertically intermediate portion thereof with a tubular pin supporting member 67 extending transversely thereof. Opposed to the pin supporting member 67 are tubular bosses 68 attached to the main frame 65 as seen in FIG. 11. A pin 69 extends through the bosses 68 and member 67 to connect the subframe 61 to the main frame 55.

Figure 12:
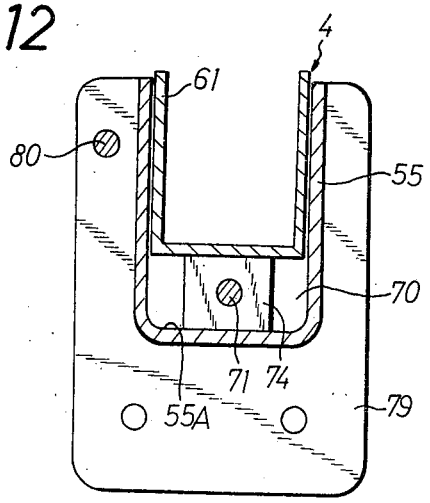
FIG. 12 is a view in section taken along the line 12—12 in FIG. 10.

The main frame 55 has a portion 70 in the form of a channel open to the front for fitting the subframe 61 therein (see FIG. 12). Inside the fitting portion 70 there is provided a vertical rod 71 rotatable relative to the main frame 55 and axially movable. The vertical rod 71 has an upper threaded portion 71A and a lower engaging portion 71B. The vertical rod 71 extends through upper and lower support plates 70A and 70B defining the fitting portion 70. The rod 71 has at its upper end an engaging portion 72 detachably provided with a handle 73, which when turned in a positive or reverse direction, rotates the rod 71 about its axis.

A pair of upper and lower locking members 74 and 75 have slanting surfaces 74A and 75A respectively on the front side. The upper locking member 74 is screwed on the threaded portion 71A of the vertical rod 71 with its slanting surface 74A opposed to the slanting wall 65 of the subframe 61, while the lower locking member 75 is fitted around the rod 71 and supported by the engaging portion 71B rotatably relative to the rod 71, the slanting surface 75A opposed to the slanting wall 66 of the subframe 61.

The locking members 74 and 75 are adapted for contact with the vertical wall 55A of the main frame 55 and with the slanting walls 65 and 66 of the subframe 61 as wedges to eliminate the backlash of the subframe 61 relative to the main frame 55.

If the subframe 61 placed in the fitting portion 70 of the main frame 55 is connected to the frame 55 merely by the pin 69, the frames will be turnable relative to each other about the single pin 69.

Accordingly the vertical rod 71 is turned about its axis by the handle 73, moving the locking member 74 downward in FIG. 10 in screw-thread engagement with the threaded portion 71A and causing the locking member 74 in turn to move the vertical rod 71 upward to force the locking member 75 upward since the member 75 is supported by the engaging portion 71B.

The upper and lower locking members 74 and 75 therefore move toward each other, bringing their slanting surfaces 74A and 75A into contact with the slanting walls 65 and 66 of the subframe 61. The resulting wedging action forces the subframe 61 leftward in FIG. 10 to eliminate the backlash of the pin 69 and thereby rigidly attach the subframe 61 to the main frame 55.

The subframe 61 is detachable from the main frame 55 by turning the vertical rod 71 reversely to move the locking member 74 upward and bring the slanting surface 74A out of engagement with the wall 65, moving the rod 71 downward by striking the rod from above to disengage the locking member 75 from the slanting wall 66 and thereafter removing the pin 69.

Although the vertical rod 71 described above has only one threaded portion 71A, the rod 71 may be formed with another threaded portion for the lower locking member 75 and rotatably supported by the main frame 55, such that the vertical rod 71, when turned, will move the locking members 74 and 75 toward each other. The slanting walls 65, 66 and slanting surfaces 74A, 75A may be inclined in directions opposite to the above-mentioned directions. Thus the walls 65 and 66 may be inclined toward the main flame rear wall 55A upward and downward respectively, with the locking member 75 used in the higher position and the member 74 used in the lower position. The subframe 61 can be locked in position also by this arrangement.

Figure 13:
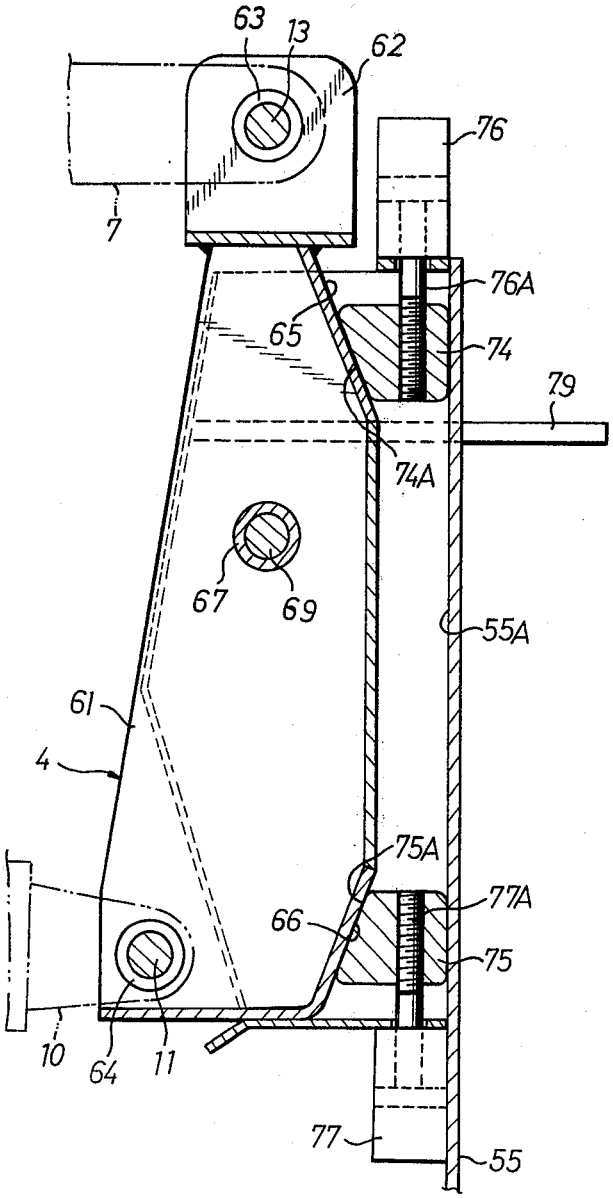
FIG. 13 is a sectional side elevation corresponding to FIG. 10 and showing another embodiment.

FIG. 13 shows another embodiment of the means for moving the locking members 74 and 75, including hydraulic cylinder means 76 and 77 attached to the top and bottom of the main frame 55 and having piston rods 76A and 77A which are fixedly screwed into the locking members 74 and 75 respectively. Otherwise the embodiment is similar to the one already described with reference to FIG. 10. The subframe 61 can be locked to or disengaged from the main frame 55 by actuating the two hydraulic cylinder means 76 and 77 in operative relation to each other to move the locking members 74 and 75 toward each other or away from each other. The hydraulic cylinder means 76 and 77 may be adapted to be operated independently of each other, whereby the boom 3 can be slightly raised or lowered independently of the operation of the lifting cylinder means 10.

When the subframe 61 is supported by the main frame 55 in the manner described above, the front loader 1 will be subjected to a counterclockwise moment (in FIG. 10) about the pin 69, and the load will be supported mainly by the locking member 75.

The locking members 74 and 75 bear on their rear side against the rear wall of the main frame 55, such that the load delivered from the subframe 61 is supported by the main frame 55 by way of the locking members 74 and 75. In addition, the locking member 75 which will be subjected to a greater load is positioned away from the pin 69 by a greater distance than the the locking member 74, namely $L_1 < L_2$ in which $L_1$ and $L_2$ are distances from the pin 69 to the locking members 74 and 75 respectively as seen in FIG. 10. In this way, the pin 69 is positioned above the midpoint between the locking members 74 and 75 so that an excess load will not act on the locking member 75 and on the portions of the main frame 55 and of the subframe 61 in contact with the member 75.

The front end of the support plate 70B is bent downward to serve as a guide portion for the subframe 61 when the subframe is to be fitted into the main frame 55 (see FIGS. 10 and 13).

FIGS. 10 to 13 show a reinforcing plate 79 welded to the main frame 55. A retaining pin 80 shown in FIG. 11 extends through the reinforcing plate 79 and through the pin 69, preventing the pin 69 from slipping off. The reinforcing plate 79 serves as a support and connection for the lower ends of the front posts 82 of a safety frame 81 shown in FIG. 2. The safety frame 81 comprises the pair of front posts 82 and another pair of rear posts 83 and has a top cover 84 to surround a control assembly such as a steering wheel 85 and seat 86 as seen in FIG. 2.

According to this invention, the front loader 1, an example of boom-type working implement, detached from the tractor 2 can be held in its upright position with good stability by the stand device 21 when the working member 6 and the lower ground engaging portion 30 of the stand member 25 are placed on the ground with the portion 30 spaced apart rearward from the working member 6 while the connecting member 28 retains the stand member 25 at an angle with the boom 3 as shown in FIG. 1. At this time, the connecting member 28 holds the stand member 25 in position relative to the boom 3, whereby the device can be made to fully withstand a load acting longitudinally of the implement. Thus the stand device 21 will not collapse even if subjected to a load exerted thereon toward the front or rear when the implement 1 is to be connected to the tractor 2. This assures extreme ease in attaching the connector 4 to the connecting assembly on the tractor 2 or disengaging the connector 4 therefrom. Additionally the stand member 25 can be held to the boom 3 coextensively therewith without any possibility of inadvertent disengagement during operation.

Although embodiments of the present invention have been described above as used for a front loader serving as a working implement, the invention is similarly useful for various boom-type working implements such as snow ploughs, field choppers and the like. In the case of a snow plough, the working member 6 is a snow discharge chute. Of course, the working member 6 need not be a bucket but can be a blade, fork or the like.

What is claimed is:

1. A stand device for a boom-type working implement having a boom provided with a working member and a connector and detachably connectable to a tractor by the connector, the stand device comprising a stand member having one end pivoted to the boom close to the working member and the other end provided with a ground engaging portion, and a connecting member having one end pivoted to the stand member and the other end pivoted to the boom, the stand member being holdable by the connecting member at an angle with the boom with the ground engaging portion positioned to the rear of the working member as spaced apart from the working member, the stand device including disengagable means for holding the stand member in a position along the length of the boom, the connecting member being holdable along the lengths of the boom and the stand member when the stand member is held along the boom.

2. A stand device as defined in claim 1 which comprises a pair of opposite stand members pivoted each at one end to a pair of opposite booms respectively and a pair of connecting members pivoted each at one end to the pair of booms respectively, the pair of stand members being connected to each other and being movable at the same time to a position along the length of the booms and to a position at an angle with the booms.

3. A stand device as defined in claim 1, wherein the stand member is made of a channel member having an open side facing the boom, the channel of the stand member serving to accomodate the connecting member therein, and the connecting member can be accomodated in the channel when the stand member is held in the position along the boom.

4. A stand device as defined in claims 1 or 3, wherein the stand member and the connecting member are positioned on one side of the boom opposite to the working member when held along the length of the boom.

5. A stand device as defined in claim 1, wherein the disengagable means for holding the stand member to the boom therealong comprises upper holding means and lower holding means, the upper holding means being provided by cooperation of a withdrawable connecting pivot for pivoting the stand member to the boom and a side wise board portion formed in an upper part of the stand member, the lower holding means being provided by cooperation of a pin extending rearward from the boom and positioned below a pivot for connecting the connecting member to the boom and a board portion formed in a lower part of the stand member.

6. A stand device for a boom-type working implement having booms provided with a working member and a connector and detachably connected to a tractor by the connector, the stand device comprising a stand member having one end detachably pivoted to a boom close to the working member in the other end provided with a ground engaging portion, and a connecting member having one end pivoted to the stand member and the other end pivoted to the boom, the stand member being holdable by the connecting member at an angle with the boom with the ground engaging portion positioned to the rear of the working member as spaced apart from the working member, the stand device including disengagable means for holding the stand member in a position along the length of the boom when the stand member is detached from the boom at the pivoted portion, the connecting member being holdable along the length of the boom and the stand member when the stand member is held along the boom.

7. A stand device as defined in claim 6, wherein the stand member has a bearing portion at said one end for a connecting pivot for pivoting the stand member to the boom, and the boom is provided with a portion for slideably guiding the bearing portion to position the stand member along the boom after the connecting pivot has been withdrawn.

8. A stand device as defined in claim 6, wherein the connecting member is pivoted to the stand member at an intermediate portion of its length, the disengagable means for holding the stand member to the boom therealong comprises upper holding means and lower holding means, the upper holding means being provided by cooperation of a withdrawable connecting pivot for pivoting the stand member to the boom and a side wise board portion formed in an upper part of the stand member, the lower holding means being provided by cooperation of a pin extending rearward from a lower portion of the boom and positioned below a pivot for connecting the connecting member to the boom and board portion formed in the stand member and engagable with the pin, the stand member being made of a channel member having an open side facing the boom, the channel of the stand member serving to accomodate the connecting member therein, the connecting member being placeable in the accomodating channel when the stand member is held in the position along the boom.

9. A stand device for boom-type working implement having a boom provided with a working member and a connector and detachably connectable to a tractor by the connector, the stand device comprising:

a stand member having one end pivoted to the boom and the other end provided with a ground engaging portion, said stand member being made of a channel member having an open side facing boom;

a connecting member having one end pivoted to the stand member and the other end pivoted to the boom, the stand member being holdable by the connecting member at an angle with the ground engaging portion positioned to the rear of the working member as spaced apart from the working member, said connecting member being arranged and configured so as to be accomodated in the channel of the stand member when the stand member is held to to boom therealong; and disengagable means for holding the stand member in a position along the length of the boom.

10. A stand device for a boom-type working implement having a boom provided with a working member and a connector and detachably connected to a tractor by the connector, the stand device comprising a stand member having one end pivoted to the boom and the other end provided with a ground engaging portion, a connecting member having one end pivoted to the stand member and the other end pivoted to the boom, the stand member being holdable by the connecting member at an angle with the boom with the ground engaging portion positioned to the rear of the working member as spaced from the working member, and a disengagable means for holding the stand member in a position along the length of the boom, said disengagable means for holding the stand member to the boom therealong comprising upper holding means and lower holding means, the upper holding means being provided by cooperation of a withdrawable connecting pivot for a pivoting the stand member to the boom and a side wise board portion formed in an upper portion of the stand member, the lower holding means being provided by cooperation of a pin extending rearward from the boom and positioning a pivot for connecting the connecting member to the boom and a board portion formed in a lower part of the stand member.

11. A stand device for a boom-type working implement having a boom provided with a working member and a connector and detachably connectable to a tractor by the connector, the stand device comprising a stand member having one end pivoted to the boom and the other end provided with a ground engaging portion, a connecting member having one end pivoted to the stand member and the other end pivoted to the boom, the stand member being holdable by the, connecting member at an angle with the boom with the ground engaging portion positioned to the rear of the working member as spaced apart from the working member, a disengagable means for holding the stand in a position along the length of the boom and a bearing portion at said one end for connecting a pivot for pivoting the stand member to the boom, and the boom is provided with a portion for slidably guiding the bearing portion to position the stand member along the boom after the connecting pivot has been withdrawn.

* * * * *

UNITED STATES PATENT AND TRADEMARK OFFICE

CERTIFICATE OF CORRECTION

PATENT NO. : 4,257,730

DATED : Mar. 24, 1981

INVENTOR(S) : HIROAKI KAWAKITA

It is certified that error appears in the above—identified patent and that said Letters Patent is hereby corrected as shown below:

On The Title Page,

At [73] Assignee: change "Dukane Corporation, St. Charles, Ill." to --Kubota Ltd., Osaka, Japan--.

As to Attorney, Agent, or Firm--change "Vogel, Dithmar, Stotland, Stratman & Levy" to --Koda & Androlia--.

Signed and Sealed this

*Thirty-first* Day of *August 1982*

[SEAL]

*Attest:*

GERALD J. MOSSINGHOFF

*Attesting Officer*

*Commissioner of Patents and Trademarks*